US007552599B2

(12) United States Patent
Herron et al.

(10) Patent No.: US 7,552,599 B2
(45) Date of Patent: Jun. 30, 2009

(54) AIR SEPARATION PROCESS UTILIZING REFRIGERATION EXTRACTED FROM LNG FOR PRODUCTION OF LIQUID OXYGEN

(75) Inventors: Donn Michael Herron, Fogelsville, PA (US); Jung Soo Choe, Gwynedd Valley, PA (US); Douglas Paul Dee, Orefield, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 460 days.

(21) Appl. No.: 11/406,440

(22) Filed: Apr. 19, 2006

(65) Prior Publication Data

US 2008/0216512 A1 Sep. 11, 2008

Related U.S. Application Data

(60) Provisional application No. 60/789,397, filed on Apr. 5, 2006.

(51) Int. Cl.
*F25J 3/00* (2006.01)
*F17C 9/02* (2006.01)

(52) U.S. Cl. ..... 62/643; 62/50.2; 62/646

(58) Field of Classification Search ..... 62/643, 62/50.2, 646

See application file for complete search history.

(56) References Cited

U.S. PATENT DOCUMENTS

| | | | | |
|---|---|---|---|---|
| 3,058,314 | A * | 10/1962 | Gardner | 62/643 |
| 3,886,758 | A | 6/1975 | Perrotin et al. | |
| 4,054,433 | A | 10/1977 | Buffiere et al. | |
| 4,192,662 | A | 3/1980 | Ogata et al. | |
| 5,137,558 | A | 8/1992 | Agrawal | |
| 5,139,547 | A | 8/1992 | Agrawal et al. | |
| 5,141,543 | A | 8/1992 | Agrawal et al. | |
| 5,220,798 | A * | 6/1993 | Nagamura et al. | 62/656 |
| 6,295,837 | B1 * | 10/2001 | Den et al. | 62/643 |
| 7,143,606 | B2 * | 12/2006 | Tranier | 62/611 |
| 7,228,715 | B2 * | 6/2007 | Brugerolle et al. | 62/643 |

FOREIGN PATENT DOCUMENTS

| | | |
|---|---|---|
| EP | 0 304 355 | 4/1991 |
| GB | 1 376 678 | 12/1974 |
| JP | 55077680 | 12/1978 |
| JP | 2005134036 | 5/2005 |

* cited by examiner

*Primary Examiner*—William C Doerrler
(74) *Attorney, Agent, or Firm*—Willard Jones; Eric J. Schaal

(57) ABSTRACT

A cryogenic air separation process is set forth wherein, in order to provide the refrigeration necessary when at least a portion of the oxygen product is desired as liquid oxygen, LNG-derived refrigeration is used to liquefy a nitrogen stream in the process. A key to the present invention is that, instead of feeding the liquefied nitrogen to the distillation column, the liquefied nitrogen is heat exchanged against the air feed to the distillation column system.

6 Claims, 6 Drawing Sheets

AIR SEPARATION PROCESS UTILIZING REFRIGERATION EXTRACTED FROM LNG FOR PRODUCTION OF LIQUID OXYGEN

This application hereby claims priority to U.S. Provisional Patent Application Ser. No. 60/789,397, filed on Apr. 5, 2006, entitled "LNG-based Liquefier Cycle For Production Of Liquid Air Components," which is incorporated herein by reference in its entirety.

BACKGROUND OF THE INVENTION

The present invention relates to the well known process (hereafter "Process") for the cryogenic separation of an air feed wherein:

(a) the air feed is compressed, cleaned of impurities that will freeze out at cryogenic temperatures such as water and carbon dioxide, and subsequently fed into an cryogenic air separation unit (hereafter "cryogenic ASU") comprising a main heat exchanger and a distillation column system which are contained in a large insulated box (generally referred to as the "cold box" in the industry);

(b) the air feed is cooled in the main heat exchanger by indirectly heat exchanging the air feed against at least a portion of the effluent streams from the distillation column system;

(c) the cooled air feed is separated in the distillation column system into effluent streams including a stream enriched in nitrogen, a stream enriched in oxygen and, optionally, respective streams enriched in the remaining components of the air feed including argon, krypton and xenon; and (d) the distillation column system typically comprises a first column (hereafter "high pressure column" or "HP column") which separates the air feed into effluent streams including a nitrogen-enriched vapor stream and a crude liquid oxygen stream; and a second column (hereafter, "low pressure column" or "LP column") which (i) operates at a relatively lower pressure than the HP column, (ii) separates the crude liquid oxygen stream into effluent streams including an oxygen product stream and one or more additional nitrogen-enriched vapor streams and (iii) is thermally linked with the HP column such that at least a portion of the nitrogen-enriched vapor from the HP column is condensed in a reboiler/condenser against boiling oxygen-rich liquid that collects in the bottom (or sump) of the LP column.

More specifically, the present invention relates to the known embodiment of the Process wherein the refrigeration extracted from liquefied natural gas (hereafter "LNG") is utilized in order to provide the refrigeration necessary when at least a portion of the oxygen product is desired as liquid oxygen. In particular, the refrigeration is extracted from the LNG by indirectly heat exchanging the LNG in a heat exchanger against one or more nitrogen-enriched vapor streams withdrawn from the distillation column in order to liquefy such nitrogen-enriched stream(s). The skilled practitioner will appreciate the contrast between using LNG to liquefy such nitrogen-enriched stream(s) and the more conventional way of providing the refrigeration necessary to make liquid oxygen product. In particular, the more conventional way consists of turbo expanding a working fluid (typically either nitrogen or air).

A key to the present invention is what happens to the nitrogen-enriched stream(s) that are liquefied against the boiling LNG. In particular, whereas the prior art introduces such stream(s) into the distillation column system, the present invention introduces such stream(s) into a heat exchanger (preferably the main heat exchanger) to be indirectly heat exchanged against at least a portion of the air feed to the distillation column system in order to liquefy at least a portion of the air feed to the distillation column system. In other words, whereas the prior art provides the LNG-derived refrigeration directly to the distillation column system, the present invention provides such refrigeration to the air feed. As further discussed herein, this has the advantage of both reducing the vapor feed to the high pressure column (thereby by allowing a smaller HP column at a smaller capital cost) and avoiding a safety hazard when, as per the prior art, the liquefied nitrogen is introduced into the distillation column directly after being indirectly heat exchanged against natural gas. In particular, in the event there is a defect in the heat exchanger used for the natural gas/nitrogen heat exchange such that natural gas leaks into the nitrogen, the leaked natural gas will be introduced directly into the distillation and thus have the potential to form very hazardous mixtures with oxygen.

The above described safety hazard is an important consideration because it leads to some of the unique features found in the below described prior art processes that utilize the refrigeration contained in LNG to aid in liquefaction.

GB patent application 1,376,678 (hereafter "GB '678") teaches the very basic concept of how LNG refrigeration may be used to liquefy a nitrogen stream. The LNG is first pumped to the desired delivery pressure then directed to a heat exchanger. The warm nitrogen gas is cooled in said heat exchanger then compressed in several stages. After each stage of compression, the now warmer nitrogen is returned to the heat exchanger and cooled again. After the final stage of compression the nitrogen is cooled then reduced in pressure across a valve and liquid is produced. When the stream is reduced in pressure, some vapor is generated which is recycled to the appropriate stage of compression.

GB '678 teaches many important fundamental principles. First, the LNG is not sufficiently cold to liquefy a low-pressure nitrogen gas. In fact, if the LNG were to be vaporized at atmospheric pressure, the boiling temperature would be typically above −260° F., and the nitrogen would need to be compressed to at least 15.5 bara in order to condense. If the LNG vaporization pressure is increased, so too will the required nitrogen pressure be increased. Therefore, multiple stages of nitrogen compression are required, and LNG can be used to provide cooling for the compressor intercooler and aftercooler. Second, because the LNG temperature is relatively warm compared to the normal boiling point of nitrogen (which is approximately −320° F.), flash gas is generated when the liquefied nitrogen is reduced in pressure. This flash gas must be recycled and recompressed.

U.S. Pat. No. 3,886,758 (hereafter "U.S. '758") discloses a method wherein a nitrogen gas stream is compressed to a pressure of about 15 bara then cooled and condensed by heat exchange against vaporizing LNG. The nitrogen gas stream originates from the top of the lower pressure column of a double-column cycle or from the top of the sole column of a single-column cycle. Some of the condensed liquid nitrogen, which was produced by heat exchange with vaporizing LNG, is returned to the top of the distillation column that produced the gaseous nitrogen. The refrigeration that is supplied by the liquid nitrogen is transformed in the distillation column to produce the oxygen product as a liquid. The portion of condensed liquid nitrogen that is not returned to the distillation column is directed to storage as product liquid nitrogen.

EP 0,304,355 (hereafter "EP '355") teaches the use of an inert gas recycle such as nitrogen or argon to act as a medium to transfer refrigeration from the LNG to the air separation plant. In this scheme, the high pressure inert gas stream is liquefied against vaporizing LNG then used to cool medium pressure streams from the air separation unit (ASU). One of the ASU streams, after cooling, is cold compressed, liquefied and returned to the ASU as refrigerant. The motivation here is to maintain the streams in the same heat exchanger as the LNG at a higher pressure than the LNG. This is done to assure that LNG cannot leak into the nitrogen streams, i.e. to ensure that methane cannot be transported into the ASU with the liquefied return nitrogen. The authors also assert that the bulk of the refrigeration needed for the ASU is blown as reflux liquid into a rectifying column.

U.S. Pat. Nos. 5,137,558, 5,139,547, and 5,141,543 (hereafter "U.S. '558", "U.S. '547", and "U.S. '543" respectively) provide a good survey of the prior art up to 1990. These three documents also teach the state-of-the-art at that time. U.S. '558 teaches cold compression to greater than 21 bara such that the nitrogen pressure exceeds the LNG pressure. U.S. '547 deals with the liquefier portion of the process—key features are cold compression to 24 bara and refrigeration recovery from flash gas. U.S. '543 further teaches to use turbo-expansion in addition to LNG for refrigeration to liquefy nitrogen.

There is little new art in the literature since the early 90's because the majority of applications for recovery of refrigeration from LNG (LNG receiving terminals) were filled and new terminals were not commonly being built. Recently, there has been resurgence in interest in new LNG receiving terminals and therefore the potential to recover refrigeration from LNG.

With respect to the ASU operation, a fundamental teaching of U.S. '758 is illustrated in FIG. 1. The facility includes an LNG-based nitrogen liquefier (2) and a cryogenic ASU (1). In this example, the cryogenic ASU includes a higher pressure column (114), lower pressure column (116), and main exchanger (110). Feed air 100 is compressed in 102 and cleaned of impurities that will freeze out at cryogenic temperatures such as water and carbon dioxide in unit 104 to produce stream 108. Stream 108 is cooled in 110 against returning gaseous product streams, to produce cooled air feed 112. Stream 112 is distilled in the double column system to produce liquid oxygen 158, high pressure nitrogen gas (stream 174) and low pressure nitrogen gas (stream 180). The nitrogen gases 174 and 180 are warmed in the main exchanger 110 to produce streams 176 and 182. Streams 176 and 182 are processed in the LNG-based nitrogen liquefier to create liquefied nitrogen product stream 184 and liquid nitrogen refrigerant stream 186. Liquid nitrogen refrigerant stream 186 is introduced into the distillation columns through valves 136 and 140.

The principle laid-out in FIG. 1 is also taught in JP 2005134036, JP 55-77680 (JP 1978150868), U.S. Pat. Nos. 4,192,662, 4,054,433, as well as the above referenced U.S. '758 and EP '355. There are two disadvantages related to processes based on FIG. 1. Firstly, should there be a leak of hydrocarbon into ASU refrigerant stream 186, that hydrocarbon will concentrate in the bottom of the lower pressure column and in liquid oxygen stream 158. Since build-up of hydrocarbon in oxygen is to be avoided, for reasons of safety, steps must be taken to ensure that such a leak does not occur in the LNG-based nitrogen liquefier. Secondly, since all of the incoming air to the cryogenic ASU (stream 108) is introduced to the higher pressure column as vapor, this requires a bigger diameter (and thus higher capital cost) for the higher pressure column.

It is therefore desired to provide an efficient process that transports refrigeration of the LNG-based nitrogen liquefier to the cryogenic ASU without the disadvantages associated with directly injecting potentially hydrocarbon laden liquid nitrogen to the distillation columns.

As used herein, "LNG-based nitrogen liquefier" shall be defined as a system that uses the refrigeration contained in LNG to convert gaseous nitrogen into liquid nitrogen. Typical of such systems, the nitrogen will be compressed in stages. If the compression is performed with a cold-inlet temperature, the LNG will be used to cool the compressor discharge by indirect heat exchange. Cooling and or liquefaction of the nitrogen will be accomplished, at least in part, by indirect heat exchange with warming or vaporizing LNG. Examples of LNG-Based Nitrogen Liquefiers can be found in the above referenced GB '678, U.S. '558, U.S. '547, and U.S. '543.

BRIEF SUMMARY OF THE INVENTION

The present invention relates to a cryogenic air separation process wherein, in order to provide the refrigeration necessary when at least a portion of the oxygen product is desired as liquid oxygen, LNG-derived refrigeration is used to liquefy a nitrogen stream in the process. A key to the present invention is that, instead of feeding the liquefied nitrogen to the distillation column, the liquefied nitrogen is heat exchanged against the air feed to the distillation column system.

BRIEF DESCRIPTION OF SEVERAL VIEWS OF THE DRAWINGS

The present invention as discussed in the Detailed Description is best understood when read in connection with the following drawings:

FIG. 5 also relates to the worked example.

DETAILED DESCRIPTION OF THE INVENTION

Figure 2:
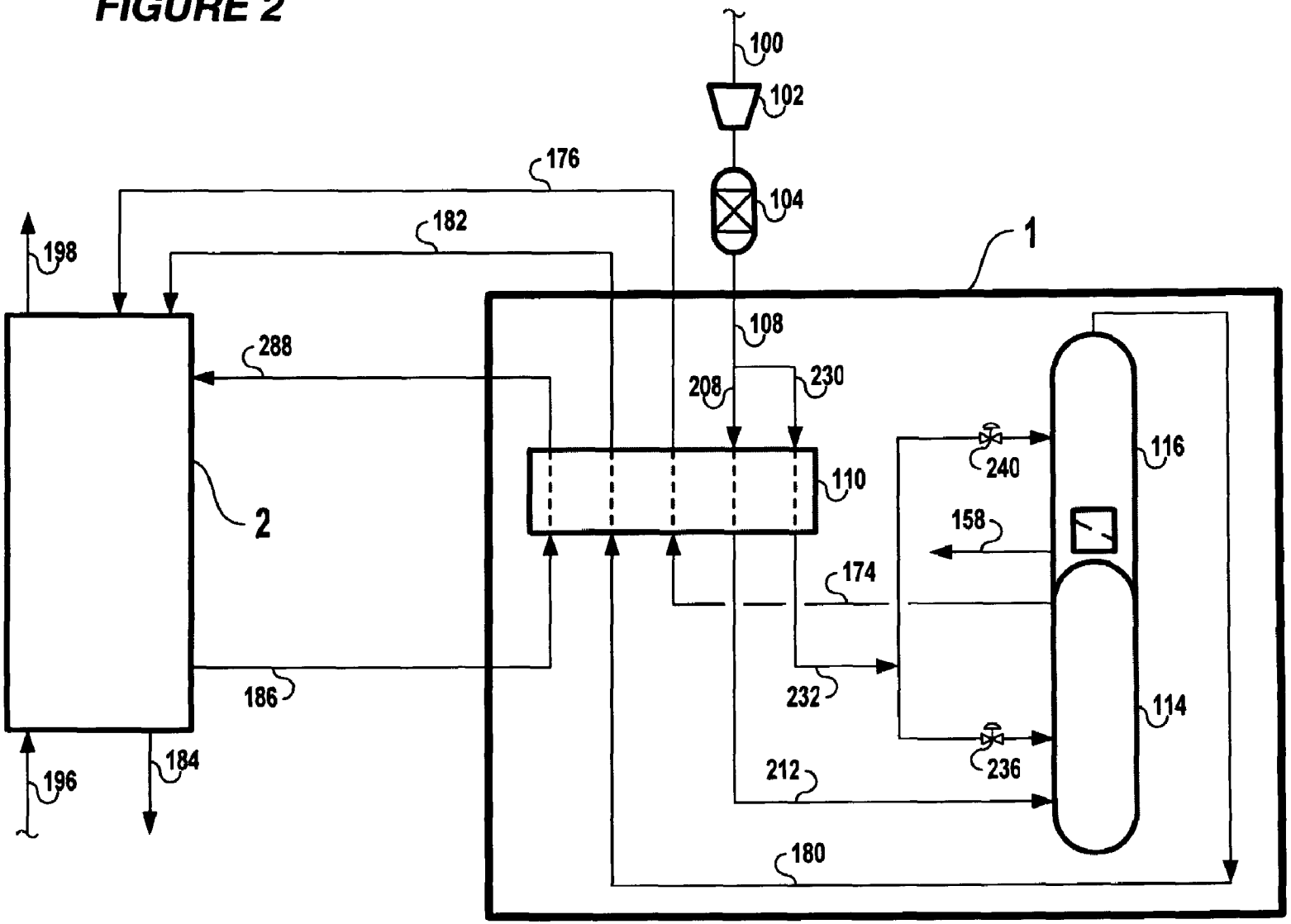
FIG. 2 is a schematic diagram of one embodiment of the present invention that illustrates how the present invention provides LNG-derived refrigeration to the cryogenic ASU.

The basic concept of the invention is illustrated in FIG. 2. The facility includes an LNG-based Nitrogen Liquefier (2) and a cryogenic ASU (1). In this example, the cryogenic ASU includes a higher pressure column (114), lower pressure column (116), and main heat exchanger (110). Feed air 100 is compressed in 102 and cleaned of impurities that will freeze out at cryogenic temperatures such as water and carbon dioxide in unit 104 to produce stream 108. Stream 108 is split into a first portion 208 and a second portion 230. Stream 208 is cooled in 110 against returning gaseous product streams, to produce cooled air feed 212. Stream 230 is first cooled in 110 against returning gaseous product streams then liquefied to produce stream 232. Liquid air stream 232 is split and is introduced into the distillation columns through valves 236 and 240. Streams 212 and 232 are distilled in the double column system to produce liquid oxygen 158, high pressure nitrogen gas (stream 174) and low pressure nitrogen gas (stream 180). The nitrogen gases 174 and 180 are warmed in the main exchanger 110 to produce streams 176 and 182. Liquid nitrogen refrigerant stream 186 is directed to the main exchanger where it is vaporized by indirect heat exchange with condensing stream 230 to form vapor nitrogen return stream 288. Streams 288, 176 and 182 are processed in the LNG-based nitrogen liquefier to create liquefied nitrogen product stream 184 and liquid nitrogen refrigerant stream 186.

In one key embodiment of the invention, the liquid nitrogen refrigerant stream is vaporized at a pressure less than that of the air stream 108. This is done to ensure that, should there be a leak of hydrocarbon into the liquid nitrogen refrigerant stream from the LNG-based Nitrogen Liquefier, and should there also be a leak between the liquid nitrogen refrigerant stream and the incoming air (e.g. in the main heat exchanger), the hydrocarbon initially leaked from the LNG-based nitrogen liquefier will not find its way into the distillation columns. In practice, the pressure difference between these two streams can be small, on the order of 0.1 bar.

Figure 1:
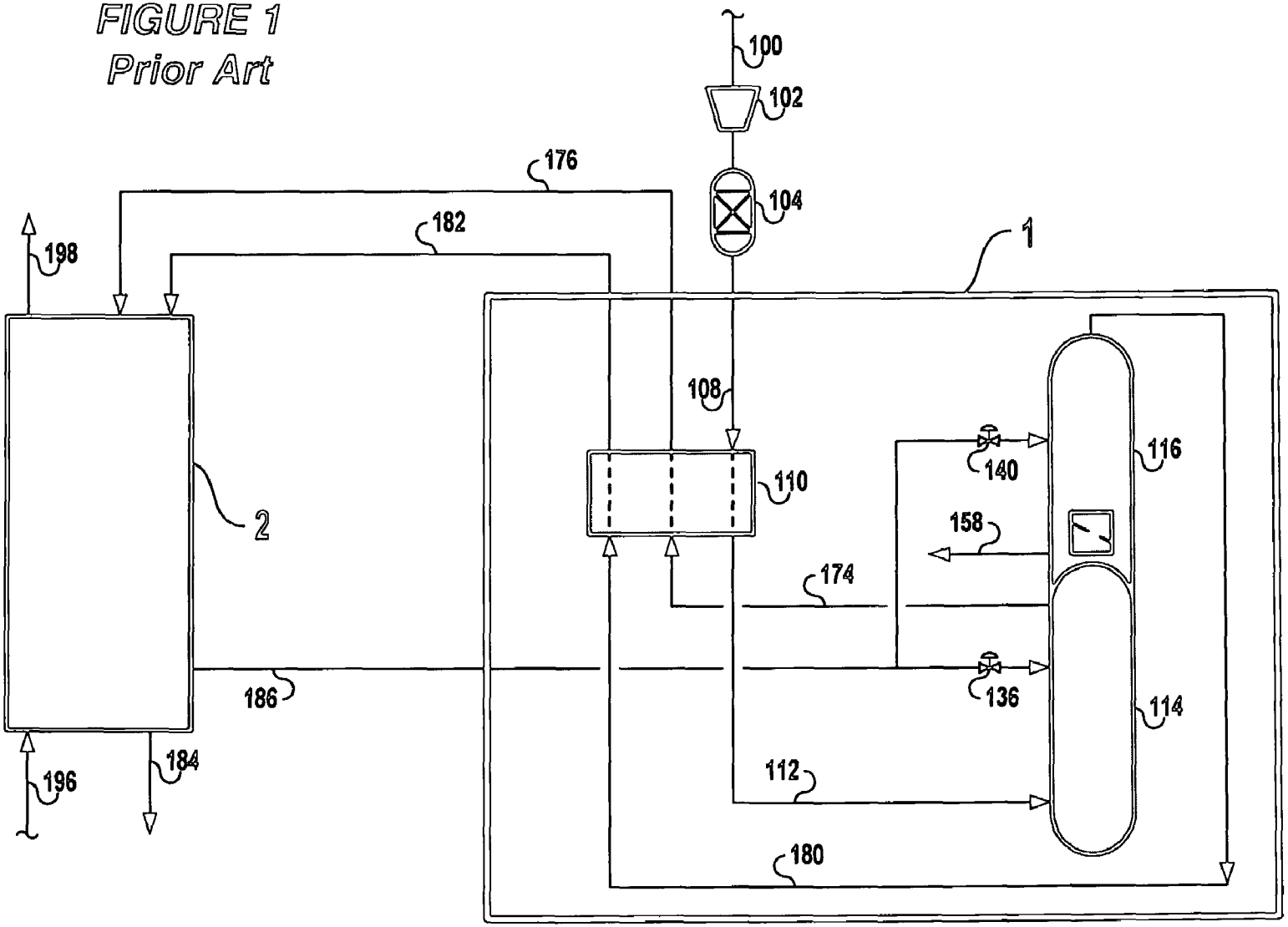
FIGURE 1 Prior Art
FIG. 1 is a schematic diagram that illustrates how the prior art provides LNG-derived refrigeration to the cryogenic ASU.

In FIG. 2, it is preferred that stream 232 be totally condensed. Owing to the differences in latent heat between the air stream 232 and the liquid oxygen stream 158, the flow of stream 232 will be approximately 1.4 times the flow of liquid oxygen stream 158. Typically, the flow of oxygen stream 158 is 20 to 21% of incoming air stream 108, in which case the flow of stream 232 is approximately 28-29% and the flow of stream 212 is 72-71%. In other words, the vapor flow to higher pressure column 114 is approximately 72% of air. In contrast, for the process of FIG. 1, vapor flow to higher pressure column 114 is approximately 100% of air. It is apparent then, that this invention has an advantage over the prior art in that the higher pressure column will be of smaller diameter and therefore, of lower cost.

For the process of FIG. 2, the oxygen recovery is maximized if stream 232 is totally condensed. However, it is possible to operate the invention with stream 232 only partially condensed. In this case, the flow of stream 232 will increase because there will still be approximately 28-29% of air as liquid in the stream. In the limit, if the flow of stream 208 were reduced to zero then the flow of stream 232 would be 100% and the liquid fraction of stream 232 would be 28-29%. Operation in this manner has the virtue of making the design of the main exchanger 110 simpler, hence capital cost will be lower, although oxygen recovery will be lower. Therefore the decision between options will depend on the economic trade off of capital and power.

Figure 3:
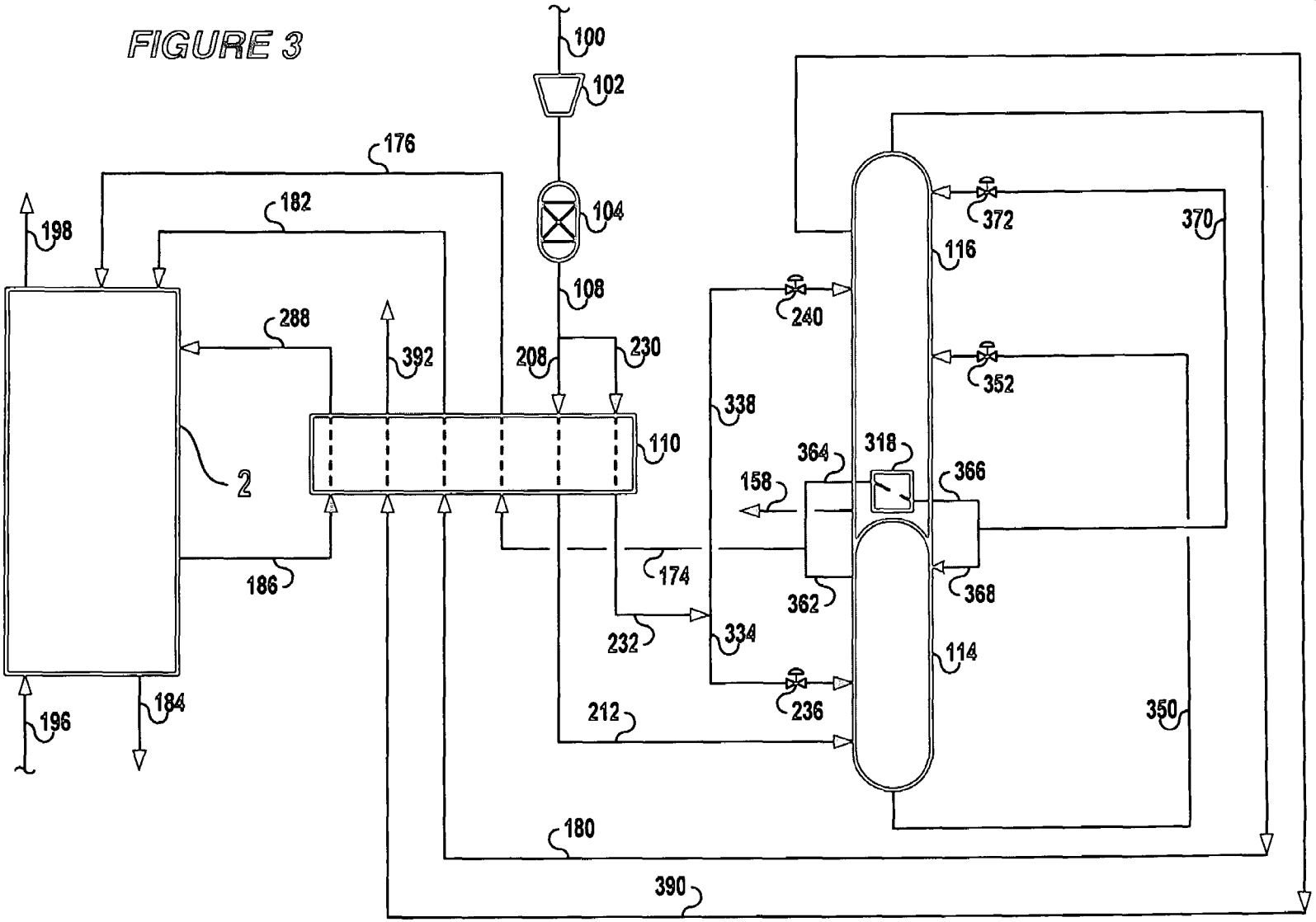
FIG. 3 is a schematic diagram similar to FIG. 2 except it includes features and details of the cryogenic ASU omitted from FIG. 2 for the sake of simplicity.

For the sake of simplicity, many of the features and details of a cryogenic ASU have been omitted from FIG. 2 which are provided by FIG. 3. Atmospheric air 100 is compressed in the main air compressor 102, purified in adsorbent bed 104 to remove impurities such as carbon dioxide and water, and then divided into two fractions: stream 230 and stream 208. Stream 208 is cooled in main heat exchanger 110 to become stream 212, the vapor feed air to the higher pressure column 114. Stream 230 is cooled to a temperature near that of stream 212, partially condensed to form stream 232 and then split into streams 334 and 338 which are reduced in pressure across valves 236 and 240 and introduced to the higher pressure column 114 and lower pressure column 116. The higher pressure column produces a nitrogen-enriched vapor from the top, stream 362, and an oxygen-enriched stream, 350, from the bottom. Stream 362 is split into stream 174 and stream 364. Stream 174 is warmed in the main heat exchanger then passed, as stream 176 to the LNG-based liquefier. Stream 364 is condensed in reboiler-condenser 318 to form stream 366. A portion of stream 366 is returned to the higher pressure column as reflux (stream 368); the remainder, stream 370, is eventually introduced to the lower pressure column as the top feed to that column through valve 372. Oxygen-enriched stream 350 is also eventually introduced to the lower pressure column through valve 352. The lower pressure column produces the oxygen from the bottom, which is withdrawn as liquid stream 158, and a nitrogen-rich stream, 180, from the top.

Nitrogen-rich stream 180 is warmed in main heat exchanger 110 then passed, as stream 182 to the LNG-based liquefier. A waste stream may be removed from the lower pressure column, as stream 390, warmed in the main exchanger and ultimately discharged as stream 392. Boil up for the bottom of the lower pressure column is provided by reboiler condenser 318. Liquid nitrogen refrigerant stream 186 is directed to the main exchanger where it is vaporized by indirect heat exchange with condensing stream 230 to form vapor nitrogen return stream 288. Streams 288, 176 and 182 are processed in the LNG-based nitrogen liquefier to create liquefied nitrogen product stream 184 and liquid nitrogen refrigerant stream 186.

In FIG. 3, none of the lower pressure column feed streams are cooled prior to their pressure reduction and introduction to the lower pressure column. The action of cooling lower pressure column feeds is commonplace and accomplished by warming a low pressure gas stream, such as stream 180, in a heat exchanger called a subcooler. Inclusion of a subcooler in the embodiments of the invention usually becomes justified as power cost and/or plant size increases.

The production of lower pressure nitrogen stream 180 and higher pressure nitrogen stream 174 is optional. For example, if there is no liquid nitrogen product flow (there is no flow in stream 184 from the LNG-based liquefier) then there is no need for either of streams 176 or 182. In this case, the nitrogen from the cryogenic ASU leaves as waste stream 392. If the production of liquid nitrogen product stream 184 is modest compared to the production of liquid oxygen product stream 158, then typically there would be no need for low pressure nitrogen stream 180, but stream 174 would be used. If the production of liquid nitrogen product stream 184 is large compared to the production of liquid oxygen product stream 158, then typically there would be no need for high pressure nitrogen stream 174, but stream 180 would be used. For intermediate production levels of liquid nitrogen, both stream 174 and 180 would be employed. It would be apparent to one of normal skill in the art which combination is best—i.e. it is simply an economic optimization.

Additionally, the embodiments of the invention could also include the coproduction of gaseous nitrogen product. In such an event, one may elect to use a portion of low pressure stream 182 as nitrogen product. Alternatively, one may elect to use a portion of high pressure stream 176 as nitrogen product. When nitrogen coproduct is withdrawn from the top of the higher pressure column it is also common, though not necessary, to extract the lower pressure column reflux stream, 370, from a position in the higher pressure column a number of stages below the top of the higher pressure column. In this event, all of reboiler-condenser condensate stream 366 is returned to the higher pressure column. Furthermore, one might elect to recover gaseous nitrogen from the LNG-based liquefier—this might be done if the pressure of the nitrogen exceeds that typical of either streams 176 or 182.

Additionally, in FIGS. 2 to 3 it is shown that the condensed air stream 232 is sent to both columns. It is possible, and often justified, to send all of stream 232 to either the higher pressure column or lower pressure column. Alternatively, all of stream 232 may be sent to the higher pressure column and liquid may be withdrawn from the higher pressure column from the same location as which stream 232 was introduced. As still another alternative, one may eliminate condensed air stream 232 altogether. The associated streams 230, 334, 338, and valves 236 and 240, would also be eliminated. In this event, the single air stream 212 would be partially condensed against the vaporizing nitrogen refrigerant stream 186 and stream 212 would constitute a second feed to the higher pressure column.

In FIGS. 2 and 3, the sole oxygen product from the lower pressure column is stream 158. Though not shown, one could make gaseous oxygen coproduct as well. This can be accomplished in a number of different ways. For example, oxygen may be withdrawn as a vapor from the bottom the lower pressure column, warmed in the main exchanger, and compressed. Additionally, the vapor oxygen stream may simply be mixed with waste stream 390. Alternatively, a portion of oxygen stream 158 may be vaporized in the main exchanger and delivered as product.

In FIGS. 2 and 3 the condensation of stream 230 and vaporization of stream 186 is shown to take place in the main exchanger. It is within the scope of the present invention to perform this condensation and vaporization by indirect heat exchange in a separate heat exchanger.

Figure 4:
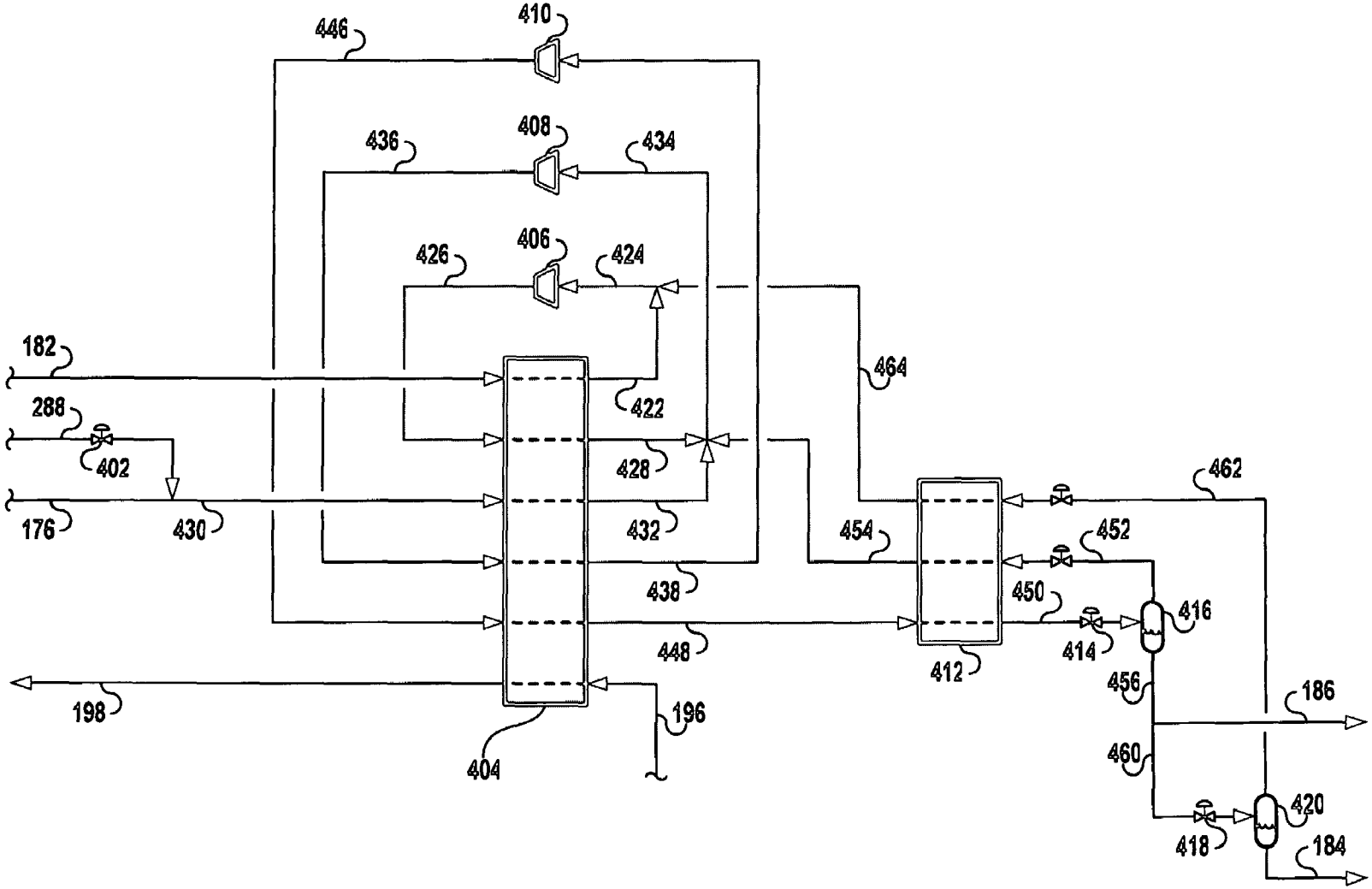
FIG. 4 is a schematic diagram that shows one example of how the LNG-based nitrogen liquefier of the present invention could be configured and relates to the worked example.

The nature of the LNG-based liquefier is not the focus of the invention, however, an example of an LNG-based Liquefier (unit 2 in FIGS. 1-3) is described in FIG. 4. Low pressure nitrogen vapor stream 182 is cooled in liquefier exchanger 404 to make stream 422, which is subsequently mixed with return vapor stream 464 to form stream 424. Stream 424 is compressed in LP cold compressor 406 to form stream 426. Stream 426 is cooled in liquefier exchanger 404 to make stream 428, which is subsequently mixed with return vapor stream 454 and chilled stream 432 to form stream 434.

High pressure nitrogen vapor stream 176 is mixed with vapor nitrogen return stream 288 to form stream 430, which is subsequently cooled in liquefier exchanger 404 to form stream 432. Stream 434 is compressed in HP cold compressor 408 to form stream 436. Stream 436 is cooled in liquefier exchanger 404 to make stream 438, is compressed in VHP cold compressor 410 to form stream 446. Stream 446 undergoes cooling and liquefaction in liquefier exchanger 404 to make stream 448.

Liquefied stream 448 is further cooled in cooler 412 to form stream 450. Stream 450 is reduced in pressure across valve 414 and introduced to vessel 416 where the two phase fluid is separated to vapor stream 452 and liquid stream 456. Liquid stream 456 is split into two streams: stream 460 and stream 186, which constitutes the liquid nitrogen refrigerant stream that is directed to the cryogenic ASU. Stream 460 is reduced in pressure across valve 418 and introduced to vessel 420 where the two phase fluid is separated to vapor stream 462 and liquid nitrogen product stream 184. Vapor streams 462 and 452 are warmed in cooler 412 to form streams 464 and 454, respectively.

Refrigeration for the LNG-based liquefier is supplied by LNG stream 196, which is vaporized and or warmed in liquefier exchanger 404 to form stream 198.

In the strictest sense, the terms "vaporized" and "condensed" applies to streams that are below their critical pressure. Often, the streams 446 (the highest pressure nitrogen stream) and 196 (the LNG supply) are a pressures greater than critical. It is understood that these streams do not actually condense or vaporize. Rather they undergo a change of state characterized by a high degree heat capacity. One of normal skill in the art will appreciate the similarities between possessing a high degree of heat capacity (at supercritical conditions) and possessing a latent heat (at subcritical conditions).

There are numerous variation on the liquefier design presented in FIG. 4. One distinction of note is as follows. The liquid nitrogen refrigerant stream 186 is shown to be withdrawn from intermediate pressure separator 416. This is done for reasons of convenience. However, it would be within the spirit of the invention for stream 186 to be withdrawn from lower pressure separator 420. It would also be possible to send all the liquid produced by the liquefier to storage (not shown) and to withdraw stream 186 from storage. In either of these two cases, it would be desirable to pump stream 186 to a suitable pressure before it is directed to the ASU.

The following example has been prepared to show possible operating conditions associated with this process. For this example, the invention is depicted by the LNG-based liquefier of FIG. 4 and the cryogenic ASU of FIG. 5. This process is compared to prior art teachings. The prior art teachings would lead to the process depicted by the LNG-based liquefier of FIG. 4 and the cryogenic ASU of FIG. 6.

Figure 5:
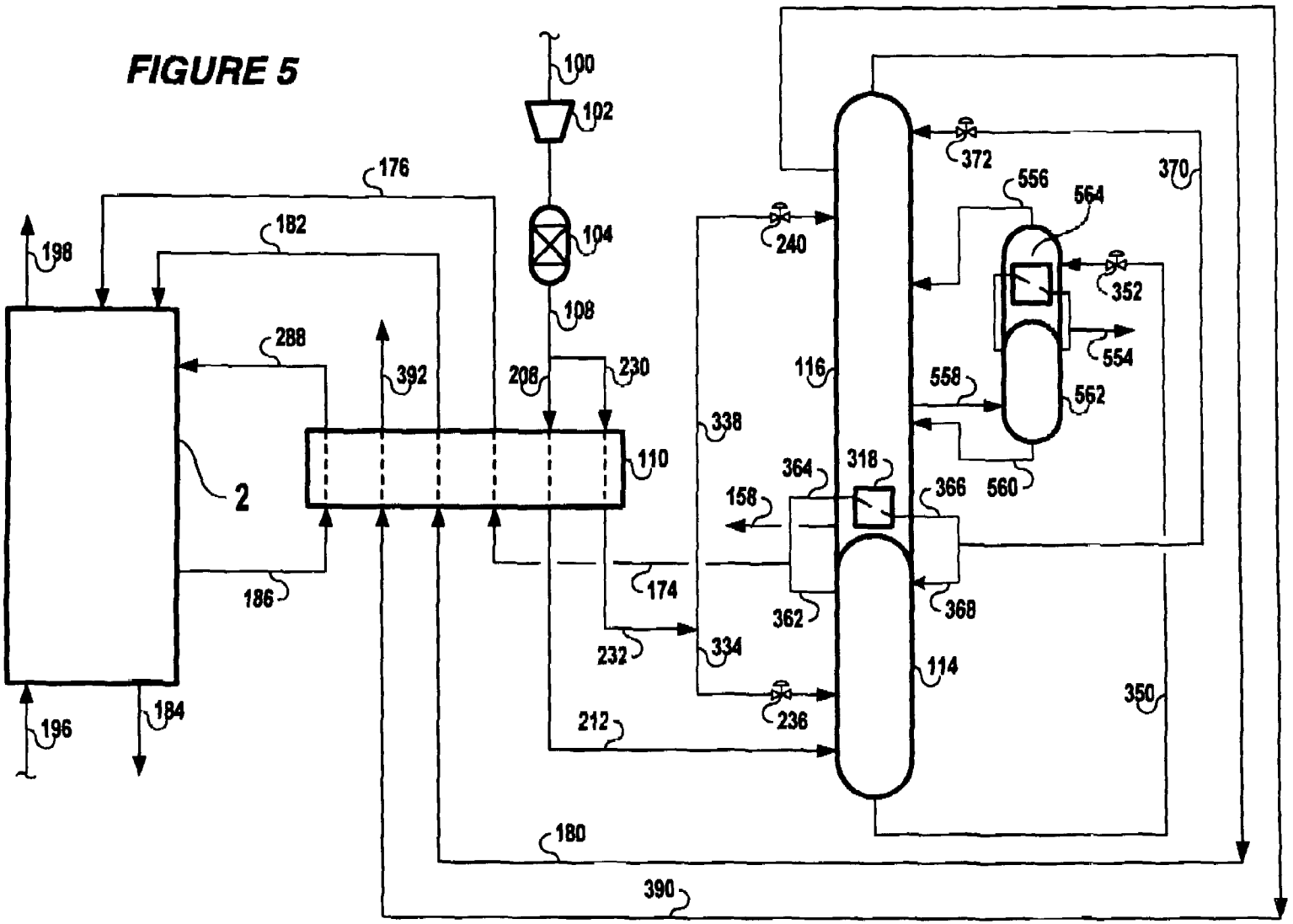
FIG. 5 is similar to FIG. 3 except the cryogenic ASU incorporates a side argon column.

FIG. 5 is similar to FIG. 3 except that an argon column 562 has been added. Referring to FIG. 5, a vapor flow is extracted from the lower pressure column as stream 558 and fed to argon column 562. Argon product is withdrawn from the top of this column as liquid stream 554. Bottom liquid stream 560 is returned to the lower pressure column. The reflux for the argon column is provided by indirect heat exchange with vaporizing an oxygen-enriched stream, which originates from the higher pressure column as stream 350. Stream 350 is passed though valve 352 into the reboiler-condenser 564, and at least partially vaporized to form stream 556, which is directed to the lower pressure column. Selected results from the rigorous simulation of invention, as indicated by FIGS. 4 and 5, is presented in Table 1. In this example, the flow of high pressure nitrogen vapor (stream 176) is zero.

Figure 6:
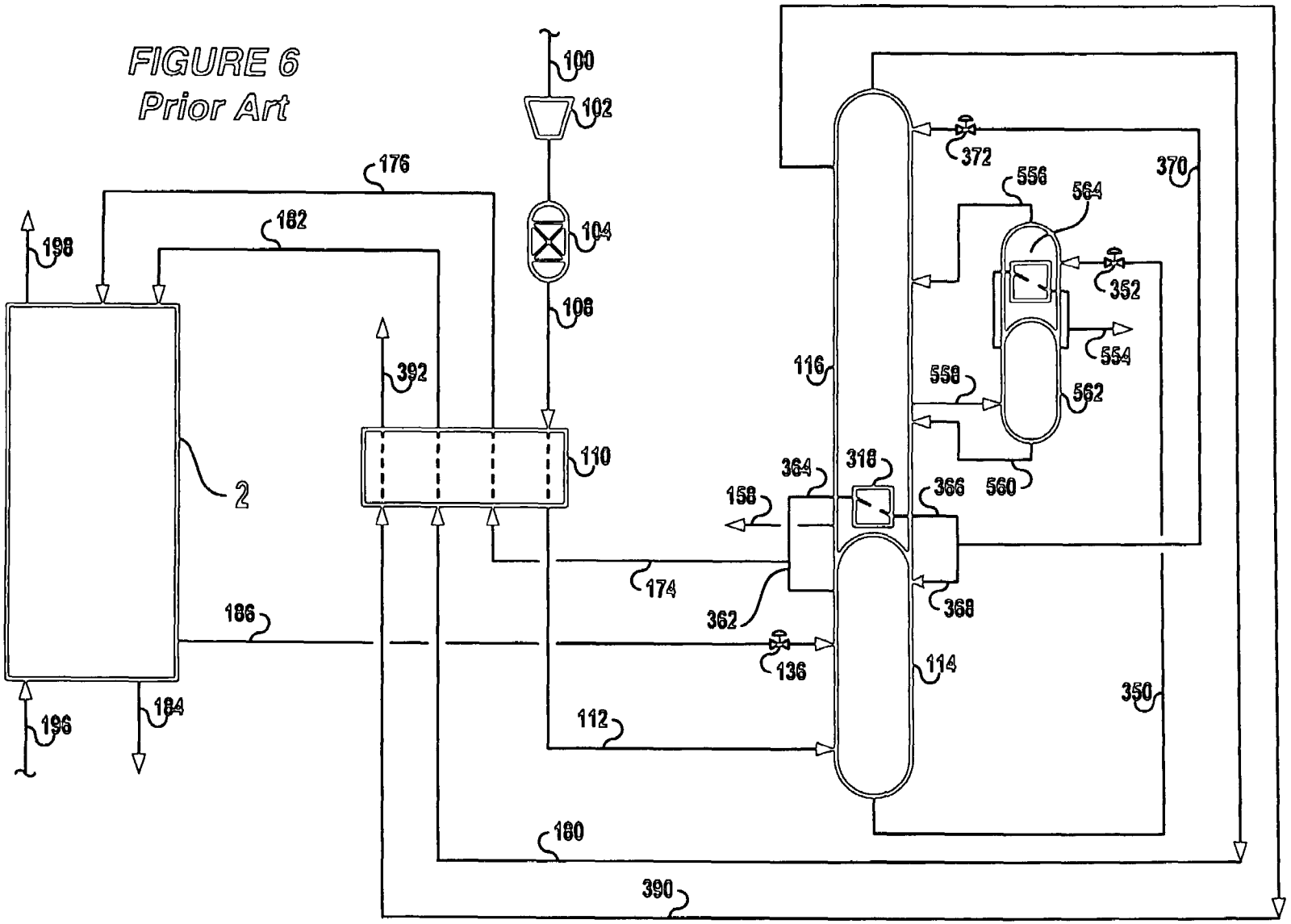
FIGURE 6 Prior Art
FIG. 6 is a schematic diagram of the prior art that is similar to FIG. 1 except that, for the purposes of comparing to FIG. 5 in the worked example, it incorporates FIG. 5's version of the cryogenic ASU.

The cryogenic ASU according to the prior art is represented by FIG. 6. Referring to FIG. 6, liquid nitrogen refrigerant stream 186 is introduced into the higher pressure column through valve 136. Two alternative cases of the prior art are considered. In the first case, denoted as Prior Art 1 in Table 1, the flow of high pressure nitrogen vapor (stream 176) is zero—just as in the example of the invention. In the second case, denoted as Prior Art 2 in Table 1, the flow of high pressure nitrogen vapor (stream 176) has been adjusted to yield the same argon production as in the example of the invention.

The results presented in Table 1 demonstrate that total power of the facility is either less than or equal to that of the prior art. Also the higher pressure column air flow is significantly lower than the prior art, as indicated by stream 212 or 112 in the table. This confirms that the higher pressure column diameter of the invention can be significantly smaller than the prior art. Finally, and most important, the disadvantages associated with directly injecting potentially hydrocarbon laden liquid nitrogen to the distillation columns are mitigated with the invention.

TABLE 1

| | | Invention | Prior Art 1 | Prior Art 2 |
|---|---|---|---|---|
| Air Flow (108) | Nm3/hr | 31,923 | 30,156 | 30,124 |
| Pressure | bara | 5.72 | 5.7 | 5.71 |

TABLE 1-continued

| | | Invention | Prior Art 1 | Prior Art 2 |
|---|---|---|---|---|
| Column Air Flow (212, 112) | Nm3/hr | 23,974 | 30,156 | 30,123 |
| Temperature | C. | −172.4 | −173.7 | −173.8 |
| Liquid Air Flow (232) | Nm3/hr | 7,949 | n/a | n/a |
| Temperature | C. | −179 | n/a | n/a |
| Liq. N2 refrigerant (186) | Nm3/hr | 8,445 | 8,536 | 8,583 |
| Pressure | bara | 5.30 | 5.30 | 5.30 |
| Liquid Oxygen Flow (158) | Nm3/hr | 5,859 | 5,847 | 5,857 |
| Liquid Argon Flow (554) | Nm3/hr | 255 | 277 | 255 |
| Liquid Nitrogen Product (184) | Nm3/hr | 20,016 | 20,016 | 20,016 |
| LP N2 Flow (182) | Nm3/hr | 20,438 | 28,974 | 23,167 |
| Pressure | bara | 1.20 | 1.20 | 1.20 |
| HP N2 Flow (176) | Nm3/hr | 0 | 0 | 5840 |
| Pressure | bara | 5.23 | 5.22 | 5.22 |
| Vap. N2 refrigerant (288) | Nm3/hr | 8,445 | n/a | n/a |
| Pressure | bara | 5.16 | n/a | n/a |
| LNG Supply Flow (196) | Nm3/hr | 90,283 | 90,283 | 90,283 |
| Pressure | bara | 75.9 | 75.9 | 75.9 |
| Temperature | C. | −154 | −154 | −154 |
| | | Power | | |
| Main Air Compressor (102) | kW | 2,603 | 2,458 | 2,457 |
| LP Compressor(406) | kW | 854 | 1,172 | 956 |
| HP Compressor(408) | kW | 1,550 | 1,676 | 1,650 |
| VHP Compressor(410) | kW | 1,574 | 1,552 | 1,520 |
| Miscellaneous | kW | 213 | 204 | 204 |
| Total | kW | 6,794 | 7,062 | 6,787 |

The invention claimed is:

1. In a process for the cryogenic separation of an air feed wherein:

(a) the air feed is compressed, cleaned of impurities that will freeze out at cryogenic temperatures, and subsequently fed into an air separation unit comprising a main heat exchanger and a distillation column system;

(b) the air feed is cooled in the main heat exchanger by indirectly heat exchanging the air feed against at least a portion of the effluent streams from the distillation column system;

(c) the cooled air feed is separated in the distillation column system into effluent streams including a stream enriched in nitrogen and a stream enriched in oxygen; and (d) in order to provide the refrigeration necessary when at least a portion of the oxygen product is desired as liquid oxygen, refrigeration is extracted from LNG by indirectly heat exchanging the LNG in a heat exchanger against one or more nitrogen-enriched vapor streams withdrawn from the distillation column system in order to liquefy such nitrogen-enriched stream(s);

the improvement comprising:

(e) indirectly heat exchanging at least a portion of the nitrogen-enriched streams liquefied in part (d) against a portion of the air feed to the distillation column system in order to fully condense the portion of the air feed to the distillation column system.

2. The process of claim 1, wherein the pressure of the liquefied nitrogen-enriched streams that are heat exchanged against the portion of the air feed in part (e) is lower than the pressure of the portion of the air feed.

3. The process of claim 1, wherein the heat exchange in part (e) is conducted in the main heat exchanger.

4. The process of claim 1, wherein the heat exchange in part (e) is conducted in a heat exchanger separate from the main heat exchanger.

5. The process of claim 1, wherein the distillation column system comprises a high pressure column which separates the air feed into effluent streams including a nitrogen-enriched vapor stream and a crude liquid oxygen stream; and a low pressure column which (i) operates at a relatively lower pressure than the high pressure column, (ii) separates the crude liquid oxygen stream into effluent streams including an oxygen product stream and one or more additional nitrogen-enriched vapor streams and (iii) is thermally linked with the high pressure column such that at least a portion of the nitrogen-enriched vapor from the high pressure column is condensed in a reboiler/condenser against boiling oxygen-rich liquid that collects in the bottom (or sump) of the low pressure column.

6. The process of claim 5, wherein a first portion of the air feed fully condensed in part (e) is fed to the high pressure column while a second portion of the air feed fully condensed in part (e) is sent to the low pressure column.

* * * * *